US008327905B2

(12) United States Patent
McDonald et al.

(10) Patent No.: US 8,327,905 B2
(45) Date of Patent: Dec. 11, 2012

(54) VERTICALLY COLLAPSIBLE BARRIER WITH IMPROVED SEALING

(75) Inventors: Mark McDonald, Beaconsfield (CA); Jack Zagorski, Saint Lazare (CA)

(73) Assignee: Railquip Enterprises Inc., Baie d'Urfe (CA)

( * ) Notice: Subject to any disclaimer, the term of this patent is extended or adjusted under 35 U.S.C. 154(b) by 112 days.

(21) Appl. No.: 12/896,214

(22) Filed: Oct. 1, 2010

(65) Prior Publication Data

US 2012/0080152 A1 Apr. 5, 2012

(51) Int. Cl.
*E06B 7/16* (2006.01)

(52) U.S. Cl. ..... 160/40; 160/84.08; 160/213

(58) Field of Classification Search ..... 160/84.08, 160/84.09, 84.11, 40, 43, 235, 229.1, 232, 160/209, 213; 49/127; 52/71
See application file for complete search history.

(56) References Cited

U.S. PATENT DOCUMENTS

| | | | | |
|---|---|---|---|---|
| 3,126,049 | A * | 3/1964 | Hollands | 160/40 |
| 3,161,229 | A * | 12/1964 | Sanders | 160/40 |
| 3,223,147 | A * | 12/1965 | Holloway | 160/84.09 |
| 3,234,996 | A * | 2/1966 | King et al. | 160/199 |
| 3,331,426 | A * | 7/1967 | Ensign | 160/199 |
| 3,628,626 | A * | 12/1971 | Merrill | 181/290 |
| 3,672,424 | A * | 6/1972 | Brown | 160/40 |
| 3,755,968 | A * | 9/1973 | Williams | 49/489.1 |
| 3,783,930 | A * | 1/1974 | Williams | 160/199 |
| 3,802,480 | A * | 4/1974 | Daggy | 160/40 |
| 4,083,395 | A * | 4/1978 | Romano | 160/199 |
| 4,357,979 | A * | 11/1982 | Marontate | 160/199 |
| 5,062,464 | A | 11/1991 | Peterson | |
| 5,339,881 | A * | 8/1994 | Owens | 160/40 |
| 5,577,348 | A * | 11/1996 | Keller | 49/317 |
| 6,267,169 | B1 | 7/2001 | McDonald | |
| 6,571,855 | B1 * | 6/2003 | Goldsmith et al. | 160/199 |
| 6,808,000 | B1 | 10/2004 | Peterson | |
| 7,156,142 | B2 | 1/2007 | Peterson | |

FOREIGN PATENT DOCUMENTS

| | | |
|---|---|---|
| AU | 653284 | 9/1994 |
| AU | 2004201914 | 11/2004 |
| CA | 2064348 | 9/1992 |
| CA | 2465433 | 11/2004 |
| CA | 2597703 | 11/2004 |

(Continued)

OTHER PUBLICATIONS

Decoustics, Ceilings: Ceilencio Custom.

Hufcor Premier Bi-Fold Door; Hufcor, Inc.; found at http://www.hufcorbifold.com/index.html; printed Oct. 26, 2009; Copyright 2008; 2 pages.

Loschwand Products; Loschwand; found at http://www.loschwand.de/eng/products/Products00.html; printed Oct. 26, 2009; 1 page.

*Primary Examiner* — David Purol
(74) *Attorney, Agent, or Firm* — Norton Rose Canada LLP

(57) ABSTRACT

A vertically collapsible wall partition is comprised of a plurality of interconnected horizontal wall panels pivotally interconnected to one another and forming horizontal panel joints therebetween. The panels are operated by an overhead lifting mechanism. The wall panels each have opposed spaced-apart composite walls each having perimeter seals to provide acoustic sound damping. The composite walls are formed by a face sheet secured to a front face of a core material and a backer sheet is secured to core material with an insulation material secured to the back of the backer sheet. Top and bottom horizontal seals are secured to the wall partition top and bottom horizontal wall panels. The seals and joints of the horizontal wall panels are such as to exhibit improved acoustic performance.

24 Claims, 3 Drawing Sheets

FOREIGN PATENT DOCUMENTS

| | | |
|---|---|---|
| DE | 69222416 | 4/1998 |
| EP | 0587572 | 9/1997 |
| EP | 1475508 | 11/2004 |
| JP | 4336614 | 9/2009 |

* cited by examiner

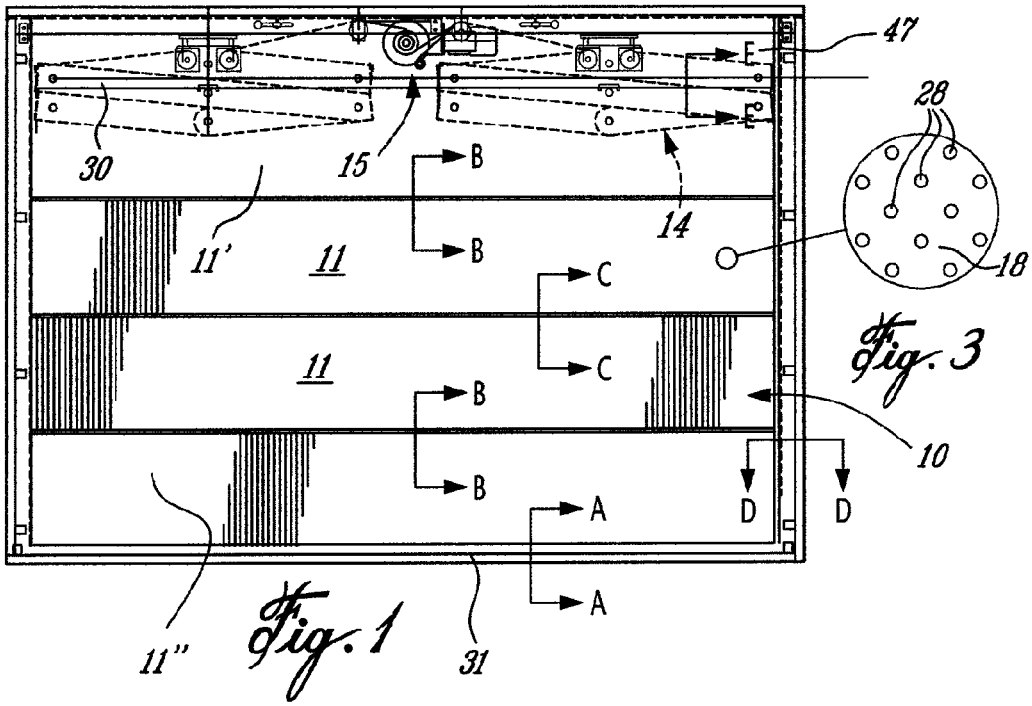
Fig. 1
Fig. 3
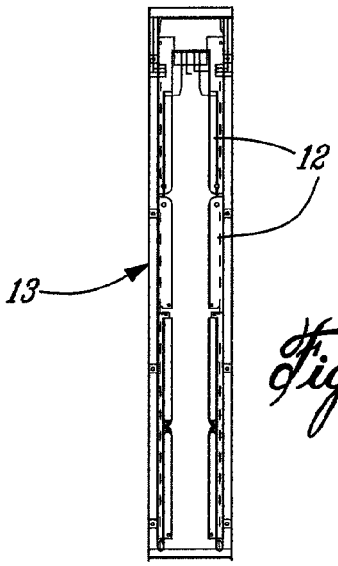
Fig. 2A
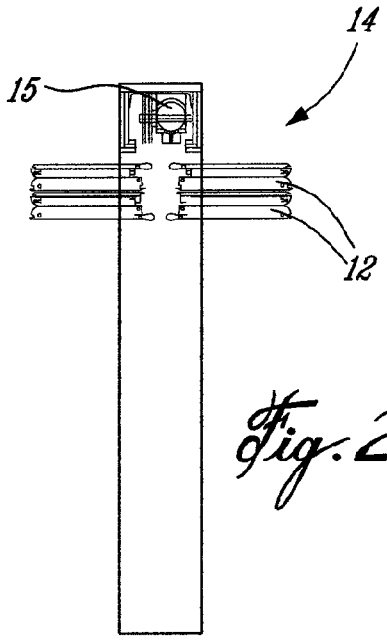
Fig. 2B

VERTICALLY COLLAPSIBLE BARRIER WITH IMPROVED SEALING

TECHNICAL FIELD

The present invention relates generally to a vertically folding wall partition having improved acoustic performances.

BACKGROUND

Vertically folding barriers or wall partitions formed by a plurality of interconnected horizontal wall panels form joints and gaps between the wall panels and the floor, ceiling and side walls of a building enclosure to be divided. Sound propagates between these joints and gaps and through the panels and it is therefore necessary to insulate these to achieve effective sound damping while maintaining contact between the ceiling and floor and side walls of the enclosure and further without hindering the proper operation of the folding wall partition. It is well known that sound levels are expressed in decibels (dB) and relate to sound pressure which may be measured in micropascals for example. As dBs are logarithmic units, the higher up the scale of sound pressure level, the more difficult it is improve the acoustic performance, which grows exponentially.

Improved acoustic properties are not guaranteed through the use of heavier gauge steel face and backer sheets, nor with the simple addition of larger, thicker and/or heavier insulation and/or seals. Acoustic consultants will admit that one cannot know with great certainty the acoustic performance of an enclosure wall until you test it. Furthermore, there are tradeoffs with adding more weight to the panels and seals. The added weight increases the stresses in the lifting mechanism and hoisting equipment and ultimately affects the limits of the system. Effective combinations of various material and seal structures are necessary to improve acoustic performance without sacrificing other performance criteria, and this requires significant research and testing of various combinations of elements.

SUMMARY

It is a feature of the present disclosure to provide a vertically folding wall partition which exhibits improved acoustic performance.

In accordance with one aspect of the present invention, there is provided a vertically folding wall partition adapted to close an opening comprising a plurality of interconnected horizontal wall panels pivotally interconnected to one another and forming horizontal panel joints therebetween, said panels being actuably secured by an overhead lifting mechanism to displace said panels from a folded storage position, wherein the opening is unobstructed, to a deployed partition forming position, wherein the opening is closed by the wall partition, said wall panels each having opposed spaced-apart composite walls forming a gap therebetween, said composite walls having side edge perimeter seals to provide acoustic sound damping; each said composite wall having a face sheet secured to a front face of a core material, a backer sheet secured to a rear face of said core material and an insulation material secured to said backer sheet facing said gap; said vertically folding wall partition having a top and bottom horizontal seal, an acoustically obstructing joint obstructing member disposed between said horizontal panel joints when said panels are in said deployed position, said composite walls, side edge perimeter seals, said top and bottom horizontal seals and said joint obstructing members in combination provide improved acoustic performance for said vertically folding wall partition.

There is also provided, in accordance with another aspect of the present invention, a vertically folding wall partition comprising: a plurality of interconnected horizontal wall panels pivotally connected to one another by horizontal panel joints therebetween, said panels being actuated by an overhead lifting mechanism to displace said panels from a folded storage position to a deployed partition forming position, said wall panels having opposed spaced-apart composite walls forming a gap therebetween; each of said composite walls having: a honeycomb core material having a face sheet secured to a front face of the honeycomb core material, a backer sheet secured to a rear face of the honeycomb core material and an insulation material secured to said backer sheet facing said gap, the insulation material being a semi-rigid fiber insulation; side edge perimeter seals to provide acoustic sound damping, the side edge perimeter seals including a first hollow flexible bulb seal having insulation therein; an acoustically obstructing joint obstructing member disposed within horizontal panel joints defined between adjacent ones of said wall panels, the joint obstructing member including an elongated lip formation formed in a lower edge of the wall panels and extending longitudinally therealong within the horizontal panel joints, said elongated lip formations abutting one another when said horizontal wall panels are in said deployed partition forming position; and said vertically folding wall partition having a top and bottom horizontal seal respectively disposed on a top and bottom one of said wall panels, each of the top and bottom horizontal seals including a second hollow flexible bulb seal and a flexible skirt outwardly extending from the top and bottom ones of said wall panels adjacent said second hollow flexible bulb seals; whereby said composite walls, said side edge perimeter seals, said top and bottom horizontal seals and said joint obstructing members in combination provide improved acoustic performance for said vertically folding wall partition.

BRIEF DESCRIPTION OF DRAWINGS

The embodiments of the present disclosure will now be described by reference to the following figures, in which identical reference numerals in different figures indicate identical elements, and in which:

FIG. 1 is a front view of a vertically folding wall partition constructed in accordance with the present invention;

FIG. 2A is a transverse vertical section view showing the vertically folding wall partition in a deployed, partition forming, position;

FIG. 2B is a view similar to FIG. 2A, but showing the vertically folding wall partition in a folded storage position;

FIG. 3 is a fragmented plan view showing the construction of the face sheet of the composite walls having perforations therein;

DETAILED DESCRIPTION

Figure 4:
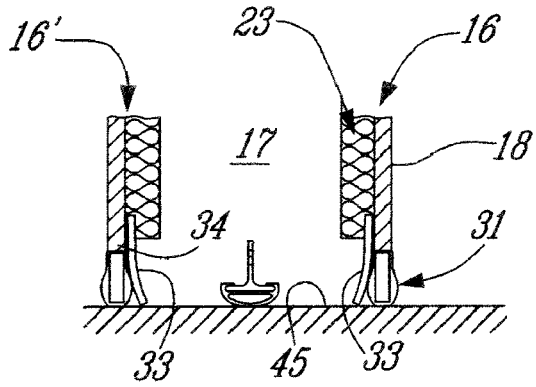
FIG. 4 is a cross-section view along cross-sections lines A-A of FIG. 1 showing the construction of the bottom horizontal seals with an elongated sensor secured in a lower edge thereof.
Figure 5:
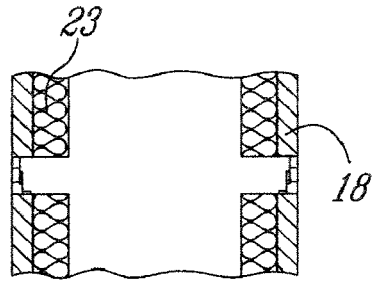
FIG. 5 is a section view along cross-section lines B-B of FIG. 1 showing the construction of the elongated lip formations and the opposed, space-apart, composite walls forming the wall panels.

Referring now to FIG. 1, there is shown generally at 10 the vertically folding wall partition constructed in accordance with one embodiment of the present disclosure. The wall partition is comprised of a plurality of interconnected horizontal wall panels 11 pivotally interconnected together by a foldable linkage 12, as better illustrated in FIGS. 2A and 2B. This wall may, for example, be of a type as described in U.S. Pat. No. 6,267,169, the contents of which are herein incorporated-by-reference.

With further reference to FIGS. 2A and 2B, it can be seen that the folding linkage 12 displaces the pivotally interconnected horizontal wall panels 11 between a fully deployed partition forming position, as shown at 13 in FIG. 2A, and a folded storage position as shown at 14 in FIG. 2B. The displacement of these panels is effected by a lifting mechanism 15 of a type known in the art.

With additional reference to FIGS. 4 to 8, it can be seen that each of the horizontal wall panels 11 are constructed of opposed spaced-apart composite walls 16 and 16' supported in spaced-apart relationship by the members forming the folding linkage mechanism 12. A gap 17 is defined between the composite walls 16 and 16'. As seen in FIGS. 4-8, this gap 17 is substantially unobstructed such as to form an air gap between the two composite walls 16, 16' of the wall panels, the gap 17 being greater than a combined thickness of the two composite walls 16, 16'.

Each of the composite walls 16 and 16' has a face sheet 18 secured to a front face 19 of a core material 20. The core material 20 in at least one embodiment is a paper honeycomb core. A backer sheet 21 is secured to a rear face 22 of the core 20. These sheets 18 and 21 are metal sheets secured by suitable adhesives. An insulation material 23 is further secured to the backer sheet 21. The insulation material may be a semi-rigid, fiberglass material known as Duraliner (registered trade-mark) insulation, which has excellent sound absorbing properties.

Figure 6:
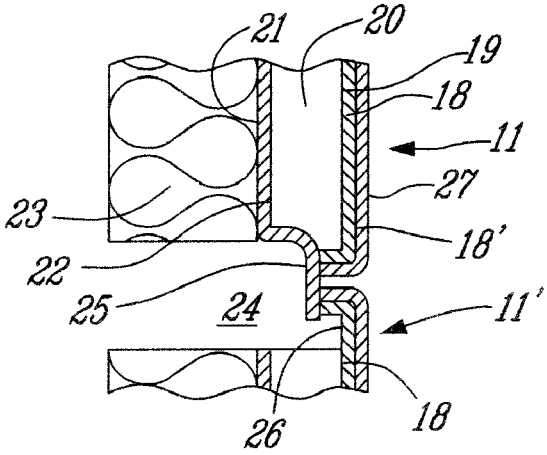
FIG. 6 is an enlarged view illustrating the construction of the elongated lip formations.

As better shown in FIG. 6, the joint 24 formed between elongated longitudinal edges of opposed panels 11 and 11' is acoustically obstructed by an obstruction member which includes, in at least the present embodiment, elongated lip formations 25 formed in a lower edge of the backer steel sheet 21 and lip formation 26 formed in the upper edge of the face sheet 18. These formations are disposed such as to separate when the panels 11 and 11' are folded during retraction thereof. They also abut each other to close the gap 24 formed in the joint between the horizontal wall panels when the panels are deployed as shown in FIG. 2A. The lip formation 25 is 0.062 inches thick for the partition models 55, 56 and 57 STC as identified in Table 1 and 0.032 inches thick for the perforated models 46 and 50 STC. The gaps 24 between the panels 11 are half (½) inch, and two (2) inches between the support header 47 and the floor 45 (see FIGS. 1 and 4). A covering 27 is also secured to the outer face of the face 18' of the sheet 18 and may be formed of vinyl or fabric material. Sound propagating in the joint is absorbed by the insulation 23.

The face sheet 18 and backer sheet 20 are formed of thin galvanized steel and in a further embodiment, the face sheet 18 of each composite wall 16 and 16' are perforated with holes 28, as shown in FIG. 3. Such a perforated face sheet 18 of at the composite walls 16,16' has been found to provide good sound absorption, which, in combination with the reduced sound transmission through the panel-to-panel gaps and the panel-to-wall gaps due to the seal constructions described herein, improves the overall acoustic perforation of the wall partition 10. The holes 28 in the face sheets 18 may, in one possible embodiment, be substantially equidistantly spaced from one another. A fabric covering material 27 is used to transmit sound when the face sheet 18 is perforated.

Figure 9:
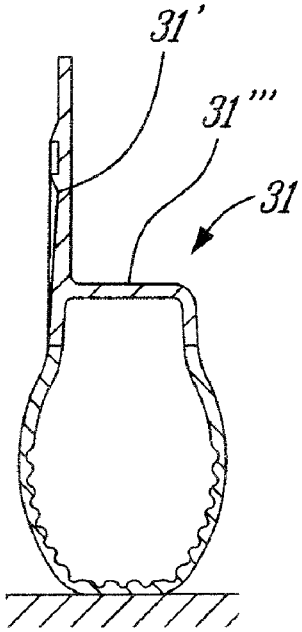
FIG. 9 is a transverse section view of the bottom bulb seal.

The vertically folding wall partition 10 of the present disclosure is further provided with top and bottom horizontal bulb seals 30 and 31 secured respectively to the top edge of the upper horizontal wall panel 11' and the lower edge of the lower wall panel 11". FIGS. 4 and 9 illustrate the construction of the bottom horizontal bulb seal 31 and the top bulb seal is slightly different in length. These bulb seals 30 and 31 are formed of mass-loaded vinyl (MLV) having a memory. As shown in FIG. 9, the bulb seal 31 has a rigid connecting flange 31' and a flexible bulb section 31" depending from a rigid top wall 31'". These bulb seals are made of PVC plastic. A flexible skirt 33 of PVC material, or other suitable material, is secured to a respective outer inner edge 34 of the backer sheet of a respective one of the upper and/or lower horizontal wall panels 11' and 11". The flexible skirt 33 associated with the top bulb seals 30 is formed from mass-loaded vinyl (MLV) having a thickness of 0.100 inches. The skirt 33 associated with the bottom bulb seals is 0.05 inch thick MLV with 0.5 inch foam insulation giving a total thickness of 0.55 inches.

In one particular embodiment, the face sheet 18 has a thickness approximately equal to a thickness of the backer sheet 21, while the insulation material 23 having a thickness of approximately 50 times that of the face sheet and backer sheet. The side edge perimeter seals may further have at least two layers of mass loaded vinyl forming a hollow bulb surrounding a polybag insulation. The flexible skirts respectively extending behind each of the bottom horizontal seal and the top horizontal seal are such that the bottom flexible skirt has a thickness approximately 5 times greater than that of the top flexible skirt of the bottom horizontal seal.

Figure 7:
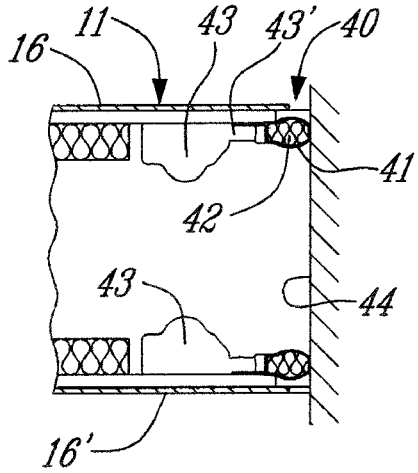
FIG. 7 is a section view along cross-section lines D-D of FIG. 1 showing the construction of the side edge perimeter seals.
Figure 8:
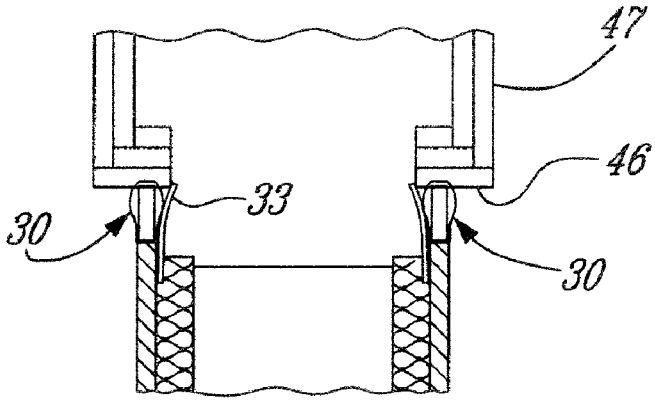
FIG. 8 is a section view along cross-section lines E-E of FIG. 1 showing the construction of the top horizontal seal.

With reference to FIG. 7, there is schematically illustrated the construction of the side edge perimeter seals 40 as secured to opposed side edges of each of the horizontal wall panels 11. As hereinshown, these side edge perimeter seals 40 are secured to respective ones of the wall panels 11 along their opposed side (i.e. lateral) edges and are identically constructed. These side edge perimeter seals 40 may include rubber seals enveloped by a double layer mass-loaded vinyl covering 41 forming a hollow envelope in which there is disposed polybag insulation 42. The polybag insulation includes fiberglass insulation in a plastic tubular bag. These perimeter seals 40 are secured to extendable arm assemblies 43' actuated by motors 43 secured adjacent the outer side edge of each wall panel 11. These actuator motors 43 are interconnected by concealed wiring, and are operable to outwardly deploy the displaceable perimeter seals 40. The perimeter seals 40 are thus extendable laterally outward and laterally retractable from the side edge of the composite wall 16 and 16' as herein shown, such as to respectively engage and disengage, as needed, a vertical wall surface 44 of a room enclosure to seal a vertical gap therebetween. Likewise, the bottom horizontal seals 31 engage a floor surface 45 and the top horizontal seal 30 engages a lower face 46 of a support header 47 which houses the overhead lifting mechanism, as respectively shown in FIGS. 4 and 8.

Below are the results of acoustic tests performed on a vertically folding wall partition such as the wall partition 10 described above, with different panel sheeting construction and covering material. In one particular example, the spaced-apart composite walls 16 and 16' are spaced a distance of approximately 11¾ inches between the outer faces thereof. All of these combinations have proven to provide improved acoustic performance as shown by the Sound Transmission Class (STC) ratings. The Rw rating is the equivalent European rating. The NRC rating is the noise reduction coefficient.

TABLE 1

| Acoustic Rating(s) | Panel Construction | Seals | Panel Finish |
|---|---|---|---|
| 55 STC (54 Rw) | 0.032" face & 0.018" back with 1.5" Ductliner insulation | Standard gap distances & standard perimeter seals with 2 layers of 0.04" Mass Loaded Vinyl. Polybag insulation in side seals & 0.1" MLV skirt behind top seal & 0.55" MLV skirt behind bottom seal. 0.062" thick steel panel lips. | Std Vinyl |
| 56 STC (56 Rw) | 0.032" face & 0.032" back with 1.5" Ductliner insulation | Standard gap distances & standard perimeter seals with 2 layers of 0.04" Mass Loaded Vinyl. Polybag insulation in side seals & 0.1" MLV skirt behind top seal & 0.55" MLV skirt behind bottom seal. 0.062"thick steel panel lips. | Std Vinyl |
| 57 STC (56 Rw) | 0.040" face & 0.032" back with 1.5" Ductliner insulation | Standard gap distances & standard perimeter seals with 2 layers of 0.04" Mass Loaded Vinyl. Polybag insulation in side seals & 0.1" MLV skirt behind top seal & 0.55" MLV skirt behind bottom seal. 0.062" thick steel panel lips. | Std Vinyl |
| 46 STC (45 Rw) 0.65 NRC (0.65 SAA) | Perforated 0.018" face & 0.032" back with 1.5" Ductliner insulation | Standard gap distances & standard perimeter seals & standard 0.032" thick steel panel lips. | Std Fabric |
| 50 STC (49 Rw) 0.65 NRC (0.64 SAA) | Perforated 0.018" face & 0.032" back with 1.5" Ductliner insulation | Standard gap distances & standard perimeter seals with 2 layers of 0.04" Mass Loaded Vinyl. Polybag insulation in side seals & 0.1" MLV skirt behind top seal & 0.55" MLV skirt behind bottom seal. Standard 0.032" thick steel panel lips. | Std Fabric |

Referring to the above Table 1, it can be seen that in the first example the face sheet had a thickness of 0.032 inches and the backer sheet a thickness of 0.018 inches. The Ductliner insulation material had a thickness of 1.5 inches. The side edge perimeter seals 40 were formed by two layers of mass loaded vinyl having a thickness of 0.04 inches, and as above-described, these seals were loaded with polybag insulation. The covering material 27 was a vinyl material. MLV skirts, disposed behind each of the top and bottom seals, provided added sealing between the wall partition and the top header and floor respectively. More specifically, a MLV skirt of about 0.1" thick is located behind the top seal and a MLV skirt of about 0.55" thick is located behind bottom seal.

In the second example, the face sheet 18 had a thickness of 0.032 inches and the backer sheet 21 a thickness of 0.032 inches. The insulation material and the construction of the edge perimeter seal and top and bottom horizontal seals, as well as the skirts associated therewith, were the same. Also the cover sheet 27 was constructed of a vinyl material.

In the third example, the face sheet 18 had a thickness of 0.040 inches and the backer sheet a thickness of 0.032 inches. The insulation material and seals as well as the cover sheet were also the same.

In the fourth example, the face sheet was a perforated metal sheet as shown in FIG. 3 having a thickness of 0.018 inches. The backer sheet was the same with a thickness of 0.032 inches. The face sheets 18 were herein covered with a fabric material. Also, the gap distances and the perimeter seals as well as the lip seals were standard seals.

In the last example, the panel construction was the same as in the previous example and the side edge perimeter seals were formed by two layers of mass loaded vinyl having a thickness of 0.04 inches filled with polybag insulation. As per the first example, the flexible MLV skirt located behind each of the top and bottom seals had a thickness of about 0.1" thick and 0.55" thick respectively. The face sheets were also covered with a standard fabric material.

The Table also shows the different acoustic ratings achieved by these various specific combinations of panel construction and seal constructions, after conducting acoustic transmission tests on each of the exemplary configurations.

It is within the ambit of the present invention to cover any other obvious modifications provided such modifications fall within the scope of the appended claims.

The invention claimed is:

1. A vertically folding wall partition adapted to close an opening comprising a plurality of interconnected horizontal wall panels pivotally interconnected to one another and forming horizontal panel joints therebetween, said panels being actually secured by an overhead lifting mechanism to displace said panels from a folded storage position, wherein the opening is unobstructed, to a deployed partition forming position, wherein the opening is closed by the wall partition, said wall panels each having two opposed composite walls which, when in the deployed position, are spaced-apart by a substantially unobstructed air gap therebetween, said composite walls having side edge perimeter seals to provide acoustic sound damping; each said composite wall having a face sheet secured to a front face of a core material, a backer sheet secured to a rear face of said core material and an insulation material secured to said backer sheet facing said gap; said vertically folding wall partition having a top and bottom horizontal seal, an acoustically obstructing joint obstructing member disposed between said horizontal panel joints when said panels are in said deployed position, said composite walls, side edge perimeter seals, said top and bottom horizontal seals and said joint obstructing members in combination provide improved acoustic performance for said vertically folding wall partition.

2. A vertically folding wall partition as claimed in claim 1 wherein said face sheet is a perforated metal sheet, and said side edge perimeter seals and said top and bottom horizontal seals including hollow bulb seals.

3. A vertically folding wall partition as claimed in claim 1 wherein said core material is a paper honeycomb core.

4. A vertically folding wall partition as claimed in claim 1 wherein at least said side edge perimeter seals are actuable by motors such as to be displaced outwardly to a sealing position in contact with an adjacent wall at least partially defining the opening.

5. A vertically folding wall partition as claimed in claim 1, wherein said face sheet and backer sheet are metal sheets and said insulation material is a semi-rigid fiberglass insulation, said side edge perimeter seals being hollow flexible seals including an external rubberized bulb having insulation material enclosed therein.

6. A vertically folding wall partition as claimed in claim 1 wherein said top and bottom horizontal seals include hollow flexible bulb seals, and a flexible skirt is secured to a respective outer inner edge of said backer sheet of a respective one of an upper and lower one of said horizontal wall panels, the flexible skirts extending away from the wall partition behind said top and bottom horizontal seals.

7. A vertically folding wall partition as claimed in claim 5 wherein said metal sheets are galvanized steel sheets.

8. A vertically folding wall partition as claimed in claim 1 wherein said joint obstructing member includes an elongated lip formation formed at a lower edge of said backer sheet and a lip formation formed at an upper edge of said face sheet and extending into said panel joints of opposed ones of said horizontal wall panels, said elongated lip formations abutting one another when said horizontal wall panels are in said deployed partition forming position.

9. A vertically folding wall partition as claimed in claim 6 wherein said face sheet has a thickness of about 0.032 inches and said backer sheet a thickness of about 0.018 inches, said insulation material having a thickness of about 1.5 inches, said side edge perimeter seals further having at least two layers of mass loaded vinyl covering having a thickness of about 0.04 inches and enclosing polybag insulation therein, said flexible skirt of said top horizontal seal having a thickness of about 0.1 inches and said flexible skirt of said bottom horizontal seal having a thickness of about 0.55 inches.

10. A vertically folding wall partition as claimed in claim 1 wherein said face sheet has an outer cover sheet formed of vinyl material.

11. A vertically folding wall partition as claimed in claim 6 wherein said face sheet has a thickness approximately equal to a thickness of the backer sheet, the insulation material having a thickness of approximately 50 times that of the face sheet and backer sheet, said side edge perimeter seals further having two layers of mass loaded vinyl forming a hollow bulb surrounding a polybag insulation, said flexible skirt of said bottom horizontal seal having a thickness approximately 5 times greater than that of the flexible skirt of said top horizontal seal.

12. A vertically folding wall partition as claimed in claim 11 wherein said face-sheet has an outer cover sheet formed of vinyl material.

13. A vertically folding wall partition as claimed in claim 6 wherein said face sheet has a thickness of about 0.04 inches and said backer sheet a thickness of about 0.032 inches, said insulation material having a thickness of about 1.5 inches, said side edge perimeter seals further having two layers of mass loaded vinyl having a thickness of about 0.04 inches and having polybag insulation enclosed therein, said flexible skirt disposed behind the top seal having a thickness of about 0.1 inches, and said flexible skirt disposed behind said bottom horizontal seal having a thickness of about 0.55 inches.

14. A vertically folding wall partition as claimed in claim 13 wherein said face sheet has an outer cover sheet formed of vinyl material.

15. A vertically folding wall partition as claimed in claim 1 wherein said face sheet is a perforated metal sheet having a thickness of about 0.018 inches, said backer sheet having a thickness of about 0.032 inches, said insulation material having a thickness of about 1.5 inches, said side edge perimeter seals and top and bottom horizontal seals being hollow bulb seals.

16. A vertically folding wall partition as claimed in claim 15 wherein said perforated face sheet has an outer cover sheet formed of fabric material to provide sound conductivity.

17. A vertically folding wall partition as claimed in claim 1 wherein said face sheet is a perforated metal sheet having a thickness of about 0.018 inches, said backer sheet having a thickness of about 0.032 inches, said insulation material having a thickness of about 1.5 inches, said side edge perimeter seals further having two layers of mass loaded vinyl having a thickness of about 0.04 inches and enclosing polybag insulation, and a flexible skirt which extends behind at least the bottom horizontal seal having a thickness of 0.55 inches.

18. A vertically folding wall partition as claimed in claim 17 wherein said perforated face sheet has an outer cover sheet formed of fabric material to provide sound conductivity.

19. A vertically folding wall partition as claimed in claim 6 wherein said spaced-apart composite walls are spaced a distance of between 11 and 12 inches between the outer faces thereof, said flexible skirt of said upper horizontal wall panel having a thickness of about 0.1 inches and said skirt of said lower horizontal wall panel having a thickness of about 0.55 inches.

20. A vertically folding wall partition comprising:

a plurality of interconnected horizontal wall panels pivotally connected to one another by horizontal panel joints therebetween, said panels being actuated by an overhead lifting mechanism to displace said panels from a folded storage position to a deployed partition forming position, each of said wall panels having two opposed composite walls which are spaced-apart such as to form a substantially unobstructed air gap therebetween;

each of said composite walls having:

a honeycomb core material having a face sheet secured to a front face of the honeycomb core material, a backer sheet secured to a rear face of the honeycomb core material and an insulation material secured to said backer sheet facing said gap, the insulation material being a semi-rigid fiber insulation;

side edge perimeter seals to provide acoustic sound damping, the side edge perimeter seals including a first hollow flexible bulb seal having insulation therein;

an acoustically obstructing joint obstructing member disposed within horizontal panel joints defined between adjacent ones of said wall panels, the joint obstructing member including an elongated lip formation formed in a lower edge of the wall panels and extending longitudinally therealong within the horizontal panel joints, said elongated lip formations abutting one another when said horizontal wall panels are in said deployed partition forming position; and said vertically folding wall partition having a top and bottom horizontal seal respectively disposed on a top and bottom one of said wall panels, each of the top and bottom horizontal seals including a second hollow flexible bulb seal and a flexible skirt outwardly extending from the top and bottom ones of said wall panels adjacent said second hollow flexible bulb seals;

whereby said composite walls, said side edge perimeter seals, said top and bottom horizontal seals and said joint obstructing members in combination provide improved acoustic performance for said vertically folding wall partition.

21. A vertically folding wall partition as claimed in claim 20, wherein said face sheet is perforated and defines a plurality of holes extending transversely therethrough, the perforated face sheet provide improved sound absorption.

22. A vertically folding wall partition as claimed in claim 20, wherein the side edge perimeter seals are horizontally outwardly displaceable relative to said composite walls from a retracted position to a laterally extended position wherein the side edge perimeter seals abut an adjacent wall surface of an opening within which the wall partition is mounted, such that the displaceable side edge perimeter seals acoustically seal a vertical gap between the wall partition and said adjacent wall surface when in said laterally extended position.

23. A vertically folding wall partition as claimed in claim 1, wherein the substantially unobstructed air gap between the two composite walls of said wall panels is greater than a combined thickness of the two composite walls of said wall panels.

24. A vertically folding wall partition as claimed in claim 20, wherein the substantially unobstructed air gap between the two composite walls of said wall panels is greater than a combined thickness of the two composite walls of said wall panels.

* * * * *